US008104407B1

(12) United States Patent
Gavin

(10) Patent No.: US 8,104,407 B1
(45) **Date of Patent: *Jan. 31, 2012**

(54) SYSTEMS AND METHODS FOR DEPLOYING AN ELECTRODE USING TORSION

(75) Inventor: William D. Gavin, Phoenix, AZ (US)

(73) Assignee: Taser International, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/963,487

(22) Filed: Dec. 8, 2010

Related U.S. Application Data

(63) Continuation of application No. 11/771,240, filed on Jun. 29, 2007, now Pat. No. 7,856,929.

(51) Int. Cl.
*F42B 10/00* (2006.01)

(52) U.S. Cl. ..... 102/502; 102/400; 361/232

(58) Field of Classification Search ..... 102/502, 102/400; 361/232
See application file for complete search history.

(56) References Cited

U.S. PATENT DOCUMENTS

| | | | | |
|---|---|---|---|---|
| 1,650,908 | A | 11/1927 | Ramsey | |
| 3,523,538 | A | 8/1970 | Shimizu | |
| 3,754,726 | A | 8/1973 | Rusbach | |
| 4,253,132 | A | 2/1981 | Cover | |
| 4,411,398 | A | 10/1983 | Wedertz | |
| 4,460,137 | A | 7/1984 | Andersson | |
| 4,858,851 | A | 8/1989 | Mancini | |
| 4,869,442 | A | 9/1989 | Miller | |
| 5,108,051 | A | 4/1992 | Montet | |
| 5,457,597 | A | 10/1995 | Rothschild | |
| 5,464,173 | A | 11/1995 | Sharrow | |
| 5,473,501 | A | 12/1995 | Claypool | |
| 5,654,867 | A | 8/1997 | Murray | |
| 5,685,503 | A | 11/1997 | Trouillot | |
| 5,698,815 | A * | 12/1997 | Ragner | 102/502 |
| 5,747,719 | A | 5/1998 | Bottesch | |
| 5,750,918 | A | 5/1998 | Mangolds | |
| 5,762,294 | A | 6/1998 | Jimmerson | |
| 5,786,546 | A | 7/1998 | Simson | |
| 5,831,199 | A | 11/1998 | McNulty | |
| 5,841,622 | A | 11/1998 | McNulty | |
| 5,898,125 | A | 4/1999 | Mangolds | |
| 5,962,806 | A | 10/1999 | Coakley | |
| 5,988,036 | A | 11/1999 | Mangolds | |
| 6,053,088 | A | 4/2000 | McNulty | |
| 6,269,726 | B1 | 8/2001 | McNulty | |
| 6,381,894 | B1 | 5/2002 | Murphy | |
| 6,477,933 | B1 | 11/2002 | McNulty | |

(Continued)

OTHER PUBLICATIONS

Edward Vasel, John Bryars, Peter Coakley, Charles Mallon, Jeff Millard, Gregory Niederhaus, and Scott Nunan, *Sticky Shocker*, Jaycor, San Diego, 1997, 7 pages.

*Primary Examiner* — J. Woodrow Eldred
(74) *Attorney, Agent, or Firm* — William R. Bachand; Lawrence Letham

(57) ABSTRACT

An electrified projectile, according to various aspects of the present invention, delivers a current through electrodes and through a target. The projectile stows the electrodes with a film and deploys the electrodes in the absence of the film. Deployment is accomplished by a release of torsion. A spur may include two electrodes and a loop. The spur may store the torsion and conduct the current.

28 Claims, 9 Drawing Sheets

U.S. PATENT DOCUMENTS

| | | | |
|---|---|---|---|
| 6,543,364 | B2 | 4/2003 | Wes |
| 6,575,073 | B2 | 6/2003 | McNulty |
| 6,588,700 | B2 | 7/2003 | Moore |
| 6,640,722 | B2 | 11/2003 | Stogermuller |
| 6,729,222 | B2 | 5/2004 | McNulty |
| 6,761,331 | B2 | 7/2004 | Eisentraut |
| 6,877,434 | B1 | 4/2005 | McNulty |
| 6,880,446 | B2 | 4/2005 | Carman |
| 6,905,093 | B2 | 6/2005 | Dryer |
| 7,042,696 | B2 | 5/2006 | Smith |
| 7,059,561 | B2 | 6/2006 | Trouillot |
| 7,234,399 | B2 | 6/2007 | Rastegar |
| 7,284,490 | B1 | 10/2007 | Mutascio |
| 7,327,549 | B2 | 2/2008 | Smith |
| 7,354,017 | B2 | 4/2008 | Morris |
| 7,905,180 | B2 | 3/2011 | Chen |
| 2006/0254108 | A1 | 11/2006 | Park |
| 2007/0101893 | A1 | 5/2007 | Shalev |
| 2010/0101445 | A1 | 4/2010 | Garg |
| 2011/0001619 | A1 | 1/2011 | Danon |

* cited by examiner

VIEW A-A

SYSTEMS AND METHODS FOR DEPLOYING AN ELECTRODE USING TORSION

CROSS-REFERENCE TO RELATED APPLICATIONS

This application is a continuation of and claims priority under 35 U.S.C. §120 from U.S. Non-Provisional patent application Ser. No. 11/771,240 filed Jun. 29, 2007 now U.S. Pat. No. 7,856,929 by Gavin, et al.

FIELD OF THE INVENTION

Embodiments of the present invention relate to deploying an electrode of an electrified projectile for providing a stimulus signal through a target.

BACKGROUND OF THE INVENTION

A conventional electrified projectile carries, among other things, electrodes and electrode deployment apparatus to the target to place electrodes a suitable distance from each other. At least 6 inch separation is believed to be necessary to stimulate sufficient skeletal muscle contractions to halt locomotion by the target. Conventional solutions for electrode deployment are not practical for low cost, small size, and minor blunt impact. Without the present invention, electrified projectiles will not see wide use for military, law enforcement, and personal defense purposes.

SUMMARY OF THE INVENTION

An electrified projectile, according to various aspects of the present invention, delivers a current through a target. The electrified projectile includes a body and an electrode. The body includes a channel. The electrode includes a spike and a loop. The loop is disposed in the channel. The loop stores a torsion. The electrode delivers the current.

A method, according to various aspects of the present invention, is performed by an electrified projectile that delivers a current through a target. The method includes, in any practical order: (a) retaining an electrode with a film; (b) unfastening the film, and (c) providing the current through the electrode. The electrode moves from a stowed position to a deployed position when the film is unfastened.

An electrified projectile, according to various aspects of the present invention, delivers a current through a target. The projectile includes a body, a first spike, and a second spike. The first spike is in mechanical communication with the second spike. The mechanical communication has a torsion. The torsion urges the spikes away from the body. The current is delivered through at least one of the spikes.

An electrified projectile, according to various aspects of the present invention, delivers a current through a target. The projectile includes a body and a spur. The body includes a signal generator. The spur includes a spike. The spur has a torsion released for deploying the spike away from the body to contact the target. The spike is coupled to the signal generator for delivering the current.

A method is performed to prepare a round for deploying an electrified projectile. The projectile provides a current through a target to incapacitate the target by causing skeletal muscle contractions. The method includes in any practical order: (a) positioning a spur in a channel of a body of the projectile; (b) storing a torsion in the spur; (c) retaining a spike of the spur substantially parallel to an axis of the body with a film; and (d) loading the round with the projectile whereby the spike deploys on release of the torsion to conduct the current.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
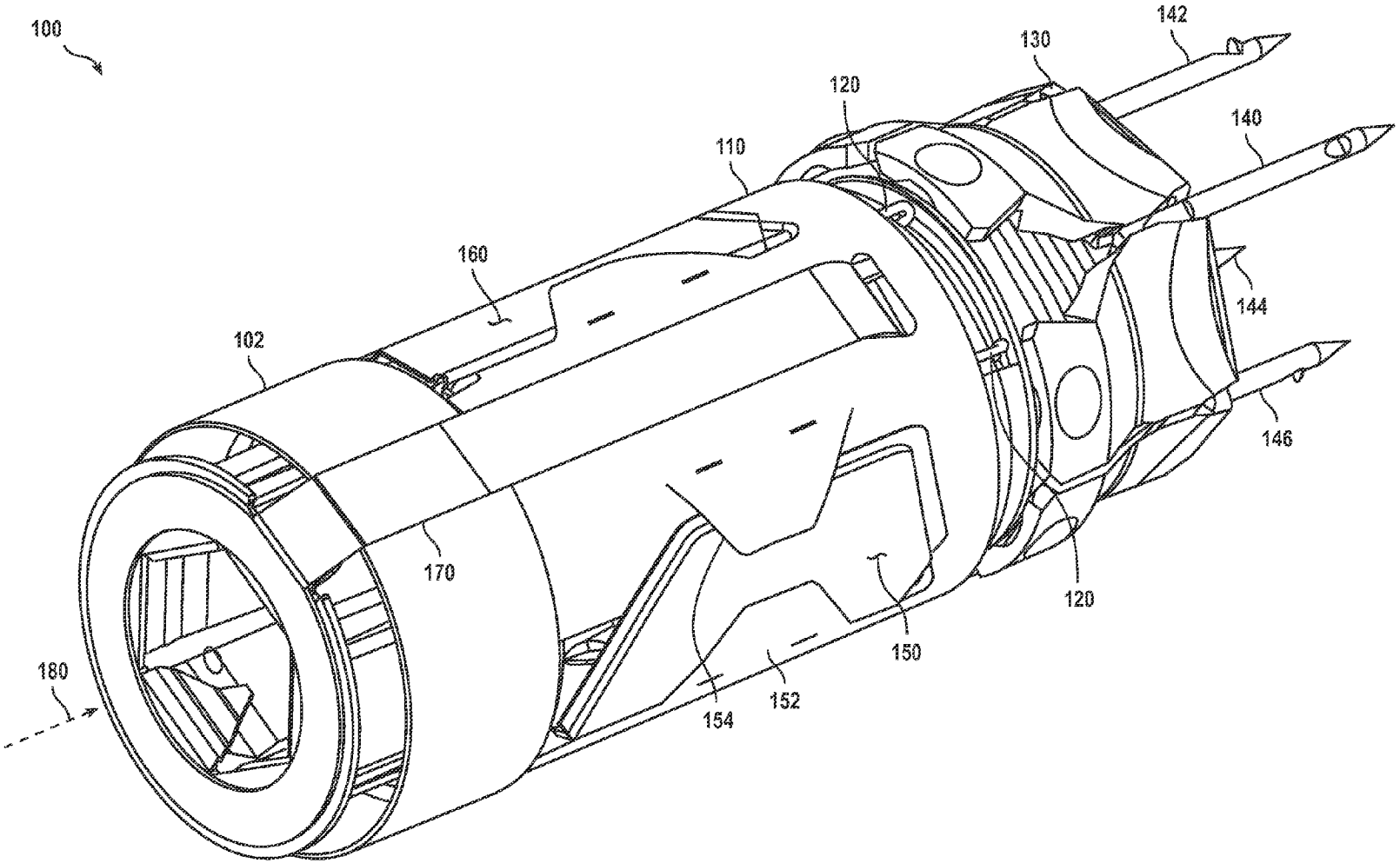
FIG. 1 is a perspective plan view of an electrified projectile, according to various aspects of the present invention, prior to loading the projectile into a shell, the shell having a propellant to launch the projectile.

An electrified projectile may be delivered to a target without a tether. The projectile may exit a launch device, fly toward the target, impact the target, deploy electrodes, and deliver a stimulus signal through the electrodes and through the target. An electrode that contacts and/or is proximate to target tissue provides a stimulus signal through the target. Increasing the number and orientation of electrodes increases the likelihood of delivering the stimulus signal.

According to various aspects of the present invention, electrodes having multiple spikes positioned at a variety of orientations deploy to increase the likelihood of delivering a stimulus signal. The electrodes require little space in a stowed position.

A round that includes an electrified projectile, according to various aspects of the present invention, maintains the projectile in a stowed condition until after launch. The round may include a propulsion system (e.g., pyrotechnic shell) and/or cooperate with a propulsion system (e.g., compressed air). Launching propels the projectile away from the round (e.g., out of a shell) and through a smooth bore barrel for impact with a human or animal target. It is desirable that the impact of the projectile with the target not cause serious injury to the target due to blunt force. Consequently, light weight electrified projectiles with relatively low muzzle velocity are desirable.

An electrified projectile includes any apparatus that establishes a circuit through a target for delivery of a stimulus signal for immobilizing the target. An electrified projectile may include an energy source (e.g., battery, charged capacitor), a circuit (e.g., signal generator and controls), and one or more electrodes. The signal generator provides an electrical stimulus signal (e.g., current) in a circuit through the electrodes and through the target sufficient to cause contraction of skeletal muscles to immobilize the target. One or more electrodes for establishing a suitable circuit for the current may be fixed to portions of the projectile or launched from the projectile (e.g., wire-tethered to a portion of the projectile). Portions of the projectile may separate from each other in flight or after impact with a target to accomplish suitable spacing between electrodes.

Electrode spacing of at least 6 inches is believed to be effective for immobilization. Delivery of the electrified projectile to the target with a desired orientation improves the likelihood of establishing a circuit with suitable electrode spacing. For an electrified projectile application, accuracy refers to effective placement of electrodes into the target at a suitable spacing.

Electrodes may be deployed to accomplish suitable spacing before launch, during flight, upon impact, or after impact. Deployment of electrodes before and/or during flight may negatively impact the aerodynamic characteristics of the projectile and interfere with accuracy. Electrodes deployment may be time delayed (e.g., until impact) to improve accuracy. It is desirable that an apparatus that delays electrode impact require little space.

It is desirable to stow electrodes during flight and deploy them when suitable electrode placement may be achieved without adversely affecting accuracy. The force of impact and/or recoil may accomplish suitable spacing. Conductors between spaced electrodes may be protected from damage due to the force of recoil. Furthermore, it is desirable that apparatus used to deploy electrodes at a suitable spacing occupy little space and use a torsion.

An electrified projectile according to various aspects of the present invention performs the functions and overcomes the problems discussed above. For example, the electrified projectile 100 of FIGS. 1-12 improves electrode deployment to provide a stimulus signal, and accuracy. Projectile 100 is of the type known as an electrified projectile as described in Ser. No. 10/714,572 now U.S. Pat. No. 7,042,696; Ser. No. 10/750,551 now U.S. Pat. No. 7,057,872; and Ser. No. 10/750,374 filed Dec. 31, 2003; all incorporated by reference. Electrified projectile 100, shown prior to loading the projectile into a shell, includes a body 102 and a nose 130. Body 102 includes a battery (not shown), a circuit having a signal generator (not shown), an activation strap 170, film 110, and three stabilizers 150, 160 and 240 (shown in FIG. 2). Film 110 includes six tabs to retain each stabilizer in a stowed position of which tabs 152 and 154 are shown retaining stabilizer 150. Body 102 further includes three spurs 120 (stowed in FIG. 1), 310, and 320 (shown in FIG. 3). Each spur includes a pair of spikes as electrodes. A stimulus signal is generally provided through a circuit that includes at least one frontal electrodes of the nose, tissue of the target, and at least one spike electrode of the body. Nose 130 includes frontal electrodes 140, 142, 144, and 146.

A body defines the shape of the electrified projectile, orients electrodes, and houses the battery and circuitry of the electrified projectile. The shape of the body may improve accuracy and/or stability of the electrified projectile, and provides a surface against which torsion may be applied. The body may permit portions of the electrified projectile to be deployed at different times. For example, body 102 is substantially cylindrical about a central axis 180 for packaging the projectile in a shell and launching the projectile from a smooth bore.

A nose retains electrodes, orients electrodes, controls the amount of separation between frontal electrodes while becoming embedded into the tissue of a target, and/or affects the amount of momentum delivered by the electrified projectile to the target at impact. A nose includes the forward portion of the electrified projectile relative to the direction of delivery. For example, nose 130 retains a plurality of frontal electrodes including electrodes 140-146. Nose 130 orients frontal electrodes 140-146 along the direction of delivery. Nose 130 includes thread 210. Body 102 and nose 130 are coupled (e.g., by rigid attachment until impacting the target) to orient the nose to the direction of delivery along body axis 180. Nose 130 is intended to impact the target before any other part of the projectile impacts the target. In flight, body 102 spins on body axis 180.

Figure 3:
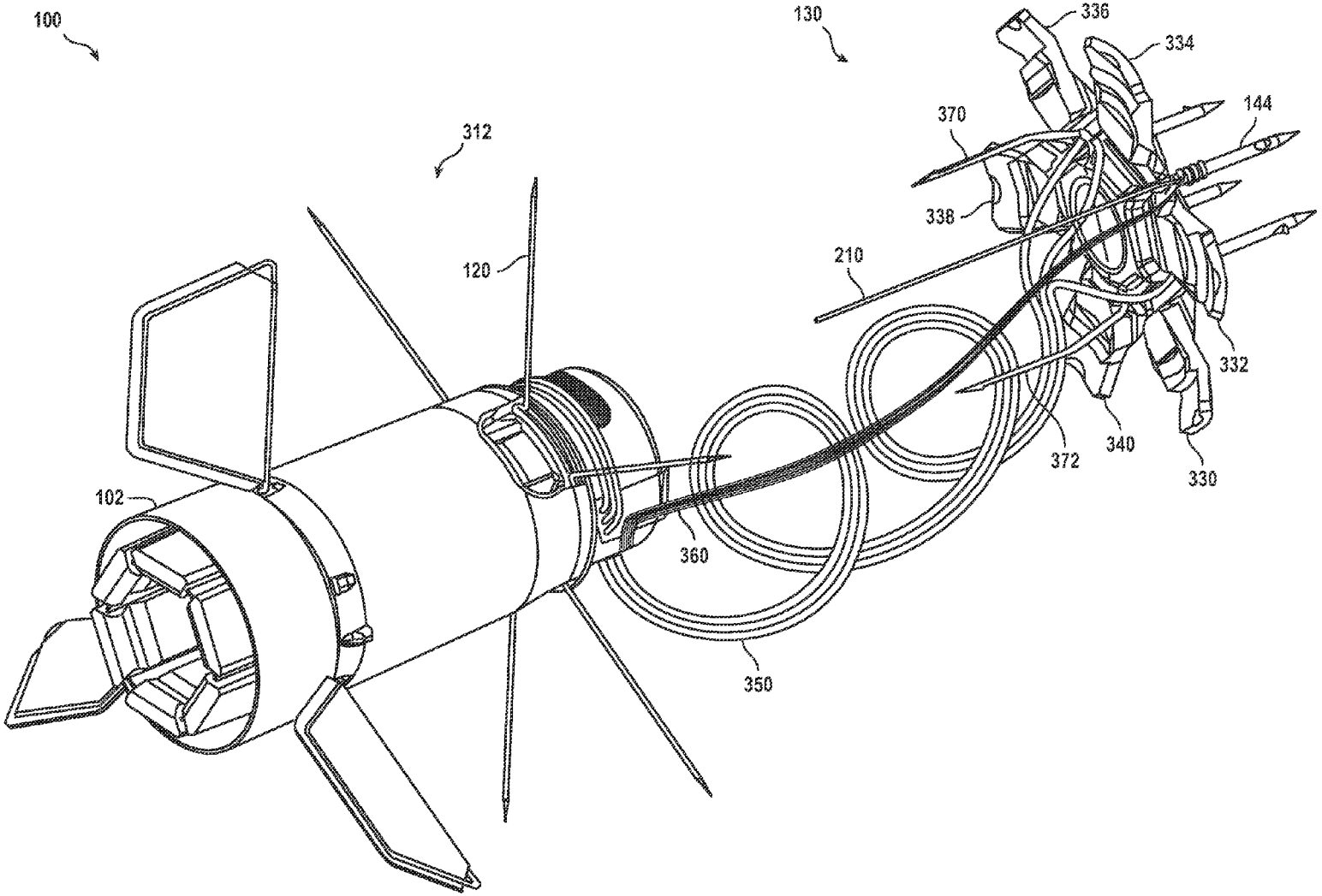
FIG. 3 is a perspective plan view of the projectile of FIG. 1 during recoil after impact.

Nose 130 may include one or more rear-facing electrodes (e.g., rear-facing electrodes 370 and 372 of FIG. 3). Target movement may establish contact with a rear-facing electrode.

Coupling between nose 130 and frontal electrodes 140-146 may affect an amount of change in electrode spacing upon entry of electrodes 140-146 into target tissue (not shown). In one implementation, frontal electrodes 140-146 are flexibly mounted to nose 130 to diverge. The distance between the respective tips of the frontal electrodes may increase as the electrodes enter target tissue. An increase in the distance between frontal electrode tips may increase the ability of frontal electrodes to remain embedded in target tissue. Each frontal electrode 140-146 may include a barb to increase the likelihood of frontal electrodes 140-146 remaining embedded in target tissue.

The material forming nose 130 may affect an amount of momentum transferred from electrified projectile 100 to the target at impact. In one implementation, nose 130 is made of a relatively flexible material that flexes upon impact to distribute the force of impact over a larger area or to transfer momentum to body 102. Any conventional rubber or plastic may be used. Foam may be used.

An electrified projectile may have a limited function state and a full function state. The limited function state facilitates storing the projectile for an extended period. In a limited function state, the electronics of the projectile consume little or no power (e.g., the projectile is "off"). The full function state includes the function of producing a stimulus signal through target tissue (e.g., the projectile is "on").

An activation strap includes any structure that facilitates switching operation of the projectile from a limited function state to a full function state. An activation strap may separate a battery from a circuit that would otherwise be in physical contact (e.g., urged together and held in electrical contact by a resilient material). For example, strap activation 170 maintains an open circuit between a battery and a signal generator of projectile 100. During launch, activation strap 170 is pulled away from body 102 and is not part of the projectile in flight or on impact.

A stabilizer improves accuracy and stability. A stabilizer may have a stowed position proximate to the projectile and a deployed position away from the projectile. For example, stabilizers 150, 160, and 240 impart spin to projectile 100 on body axis 180.

Stabilizers may be maintained in a stowed position by a film. The film may have tabs that partially cover a stabilizer. Tabs may retain a stabilizer in a stowed position as the projectile is inserted into a case, as the projectile exits the case, and as the projectile transits the barrel during launch. For example, film 110 comprises a thin sheet of plastic having tabs (e.g., 152 and 154 are typical of all six tabs of film 110) integral with the sheet to hold a stabilizer (e.g., 150) in a stowed position of the stabilizer. Stabilizer 160 is held by tabs 232 and 234. Stabilizer 240 is held by additional tabs (not shown). Tabs 152 and 154 assist to retain stored torsion in stabilizer 150 and protect stabilizer 150 during launch. In the stabilizer's stowed position, tabs 152 and 154 partially cover stabilizer 150 from a time before projectile 100 is inserted into a case of a round to a time after the projectile is launched from the round into a barrel and leaves the barrel. Release of tabs 152 and 154 permits stabilizer 150 to move to a deployed position. Tabs 152 and 154 are formed of film 110. In a preferred implementation tabs 152 and 154 are not shaped to retain a stabilizer outside a shell unassisted by manufacturing tooling yet are sufficient for assisting in handling a projectile 100 (e.g., preparing for insertion of projectile 100 into a holding fixture or into a shell).

Film 110 may include an opening for each stabilizer that permits each stabilizer to remain attached to body 102, be positioned in its stowed position, and be deployed without interfering with the position of film 110 about body 102. For example, stabilizer 240 is assembled onto body 102 before film 110 is wrapped about body 102. Opening 212 permits film 110 to avoid interference with stabilizer 240 as film 110 is wrapped around body 102 and fastened to remain surrounding body 102.

A body and a nose may have, with respect to each other, an engaged relationship and a disengaged relationship. By maintaining the engaged relationship until impact with a target, the aerodynamics of a projectile may be controlled primarily by stabilizers. A disengaged relationship facilitates placement of electrodes into the target. The body may have electrodes and the nose have additional electrodes. After being disengaged, the electrodes of the body may impact the target a suitable distance from electrodes of the nose. For clarity, the electrodes of the body of the projectile are herein called spike electrodes to avoid confusion with the body of the target.

Figure 2:
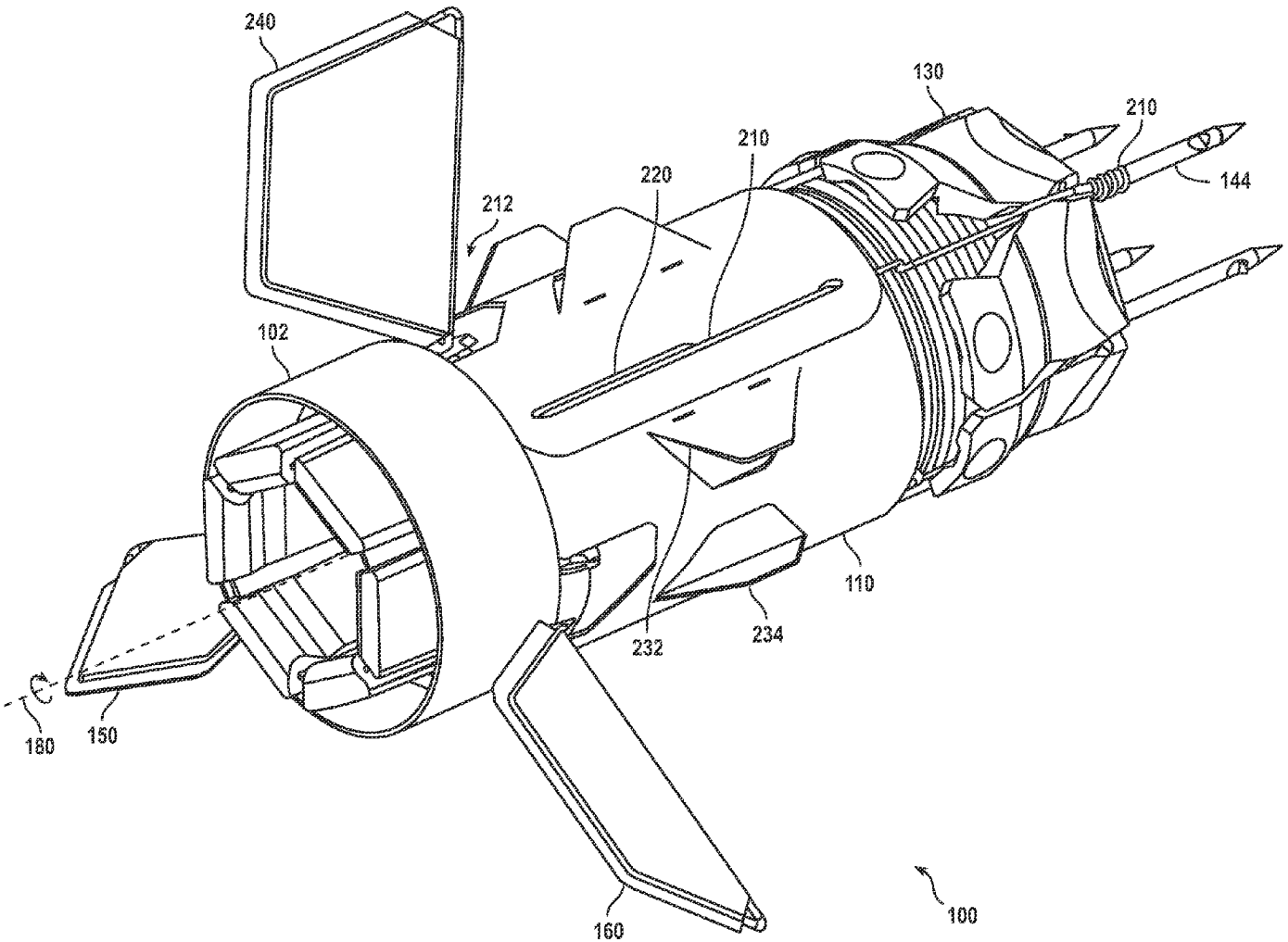
FIG. 2 is a perspective plan view of the projectile of FIG. 1 in flight.

For example, projectile 100 as shown in flight in FIG. 2 spins due to stabilizers 150, 160, and 240 and maintains an engaged relationship between body 102 and nose 130 until impact with a target (not shown). After impact, body 102 and nose 130 attain a disengaged relationship as shown in FIG. 3 and spike electrodes 120, 310, and 320 are deployed. Impact may release one or more fasteners (e.g., frangible plastic fasteners) that when released allow body 102 and nose 130 to move independently of each other. When impact lodges nose 130 in target tissue, body 102 dissipates the kinetic energy remaining after impact.

Figure 4:
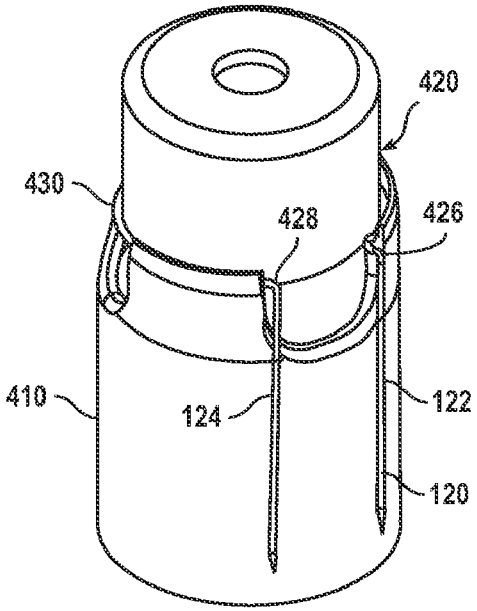
FIG. 4 is a perspective plan view of the spikes of a spur of FIG. 1 in a stowed position with film 110 omitted for clarity.
Figure 5:
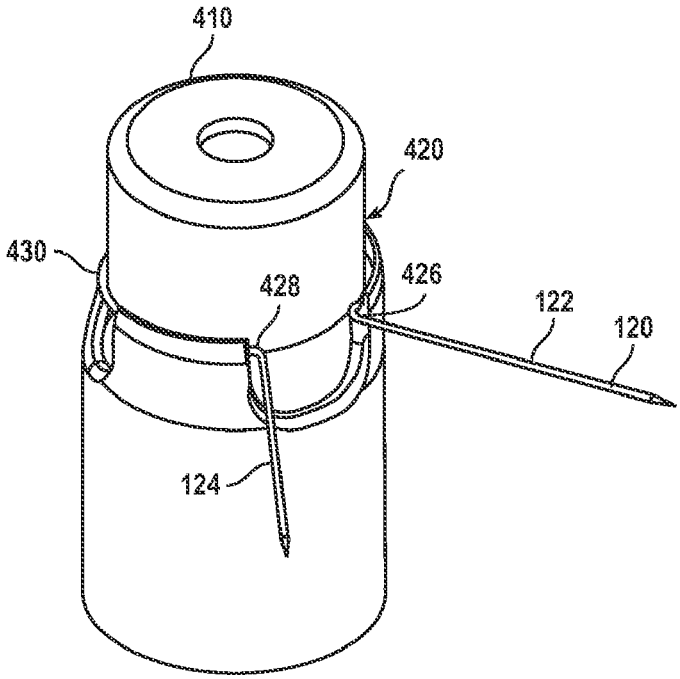
FIG. 5 is a perspective plan view of the spikes of the spur of FIG. 1 in a deployed position.

A spur includes any structure that deploys an electrode to provide a stimulus signal through a target. A spur may include one or more spikes. A spur may be formed of conductive and resilient materials. A spur may be formed of a material that is both conductive and resilient. A spike electrode has a stowed position and a deployed position. A spike electrode stows in a small space. A torsion urges a spike electrode to a deployed position. For example, in a stowed position spike electrode 120 is proximate to body 102 (FIGS. 1 and 4) and parallel to body axis 180. In a deployed position, spike electrode 120 is away from body 102 (FIGS. 3 and 5).

A film, according to various aspects of the present invention, may improve aerodynamic flight, protect a spike electrode prior to deployment, and/or retain a spike electrode in a stowed position. A film may maintain a hygienic and/or lubricated condition of a spike. Retaining electrodes covered at least in part by a film may avoid drag that deployed electrodes would otherwise provide during flight. For example, film 110 retains spike electrodes proximate to body 102 and substantially parallel to an axis 180 of body 102 during flight. Retaining a spike in a deployed position until after impact precludes slicing a target with a prematurely deployed electrode when a projectile flies beside a target, failing to impact the target. Film 110 protects spike electrodes from damage during exit of electrified projectile 100 from a barrel and during assembly.

A film may have a fastened position and an unfastened position. The fastened position may hold a spike electrode in the electrode's stowed position as discussed above. The unfastened position of the film may facilitate deployment of spike electrodes. Movement of the film from the fastened position to the unfastened position may be facilitated by release of a fastener and release of a torsion of the film. The film may include a resilient material for storing torsion. The fastener may comprise features integral to the film. In one implementation, perforations through the film and a thread may form a fastener. For example, film 110 is formed of one resilient sheet material that stores torsion when wrapped about body 102. Film 110 includes perforations (e.g., perforation 220) that permit a fastener (e.g., thread 210) to sew portions of film 110 together so that film 110, despite the torsion of its resilient material, remains wrapped about body 102 as long as thread 210 is in place (e.g., fastened position).

A thread includes any structure for closing a film through perforations in the film. A thread, according to various aspects of the present invention, releases the film in cooperation with disengagement of the body and nose. For example, thread 210 may be formed of spring wire for resistance to corrosion. Thread 210 is wrapped about frontal electrode 144 so that rearward recoil of body 102 after impact of nose 130 with a target urges film 110 to withdraw away from thread 210, releasing film 110 from its fastened position. Thread 210 may be uninsulated to provide an extension of electrode 144. If another part of the target comes into contact with thread 210, a suitable circuit for conducting stimulus current through the target may be formed. Thread 210 may have a substantial stiffness (e.g., operate as a pin).

A film may cooperate with a nose to deploy spike electrodes. A film may provide time delayed deployment of portions of an electrified projectile. A film may delay the release of electrodes until the projectile impacts a target. For example, spike electrodes 120, 310, and 320 are not deployed until film 110 is removed by separation of body 102 from nose 130. Film 110 retains spike electrodes 120, 310, and 320 in a stowed position. Before inserting electrified projectile 100 into case 1220, film 110 encircles body 102 and spike electrodes 120, 310, and 320. After projectile 100 exits the barrel, tabs of film 110 release stabilizers 150, 160, and 240, but film 110 retains spike electrodes 120, 310, and 320. Film 110 is retained in an encircling position around body 102 by a fastener. In a relaxed state, film 110 is substantially rectangular in shape having perforations 220 at opposing edges. Spike electrodes 120, 310, and 320 are held in a stowed position and encircled with film 110. Thread 210 is inserted through perforations 220 to retain film 110 in the encircled position Upon impact, frontal electrodes 140-146 embed into target tissue and nose 130 strikes the target. Barbs on frontal electrodes 140-146 help retain frontal electrodes 140-146 in target tissue such that the nose 130 remains against the target. The recoil force from impact causes body 102 to unfasten and separate from nose 130. During separation, nose 130 retains thread 210. As body 102 pulls away from nose 130, thread 210 is pulled from perforations 220. Once thread 210 is free from film 110, the torsion stored in film 110 and in spike electrodes 120, 310, and 320 pushes film 110 away from body 102 and spike electrodes 120, 310, and 320 move to a deployed position. Film 110 falls away.

When disengaged from a nose, a body and nose may remain electrically and mechanically coupled. Mechanical coupling may provide strain relief to preserve the electrical integrity of the electrical coupling. A filament, according to various aspects of the present invention, between a nose and a body may protect conductors between a signal generator in the body and electrodes in the nose. The filament may also redirect movement of the body with respect to the nose. Assuming for example that the nose is embedded in a target by impact with the target, a recoil force from this impact generally forces the body to move away from the nose and consequently away from the target. The force applied on the filament when the filament reaches its greatest extent redirects the movement of the body toward the target. As a consequence of the filament, upon impact of electrodes in the nose with the target, the body of the electrified projectile moves initially away from the target then moves toward the target. Movement of the body toward the target embeds spike electrodes in the target a distance away from the electrodes in the nose.

For example conductors 350 and filament 360 respectively electrically and mechanically couple body 102 to nose 130. Filament 360 is shorter than conductors 350 and formed of a non-elastic fiber (e.g., a poly-paraphenylene terephthalamide of the type marketed as Kevlar®). Conductors 350 electrically couple frontal electrodes 140-146 to a signal generator in body 102. Conductors 350 are wound about body 102 when body 102 is engaged with nose 130. When disengaged, conductors 350 unwind allowing separation between body 102 and nose 130 without loss or change in electrical coupling. Filament 360 mechanically couples nose 130 to body 102 to relieve strain in conductors 350 when body 102 pulls away from nose 130.

As body 102 moves away from nose 130 due to the recoil force of impact, filament 360 extends to its maximum length (e.g., from about 6 to about 24 inches). At its maximum extent, filament 360 may stop the movement of body 102 away from the target to protect conductors 350 from stretching or electrical decoupling. Filament 360 further redirects the movement of body 102 away from the target to movement toward the target such that spike electrodes 120, 310, and 320 are embedded into the target at a distance away from frontal electrodes 140-146. In an accurate impact, a circuit path between embedded frontal electrodes 140-146 and embedded spike electrodes 120, 310, and 320 is at least six inches long.

Filament 360 and/or its couplings to portions of the projectile may break after sufficient force of recoil has been absorbed to permit conductor 350 to absorb the remaining force of recoil without damage. Filament 360 may be adhered or attached to body 102. Preferably, filament 360 is disposed inside a chamber of body 102 that is then filled with a conventional potting compound that retains filament 360, mechanically coupling it to body 102.

Conductors between the body and the nose conduct a stimulus signal between a signal generator and the frontal electrodes. Any portion of any conductor between the body and the nose may comprise uninsulated, exposed, conductor to serve the same function as a rear-facing electrode as discussed above.

A spur, according to various aspects of the present invention, may bias a spike for deployment and may bias it to remain deployed. A spur may include a first spike and a second spike in mechanical communication with the first spike. A spike delivers a stimulus signal to a target. A spike penetrates clothing and/or target tissue. For example, spikes 422 and 424 of spur 120 each have a sharp end. Each spike 422 and 424 may include a barb to increase the likelihood of spur 120 remaining in electrical contact with target tissue.

A mechanical communication between spikes may store a torsion. The torsion may urge the spikes of a spur to a deployed position. The torsion may be sufficient to deploy one or more spikes and push film 110 away from body 102. Any structure may be used to couple a plurality of spikes to form a spur. According to various aspects of the present invention, a structure for mechanical coupling between spikes may store a torsion and/or conduct the stimulus signal to one or more spikes.

Figure 6A:
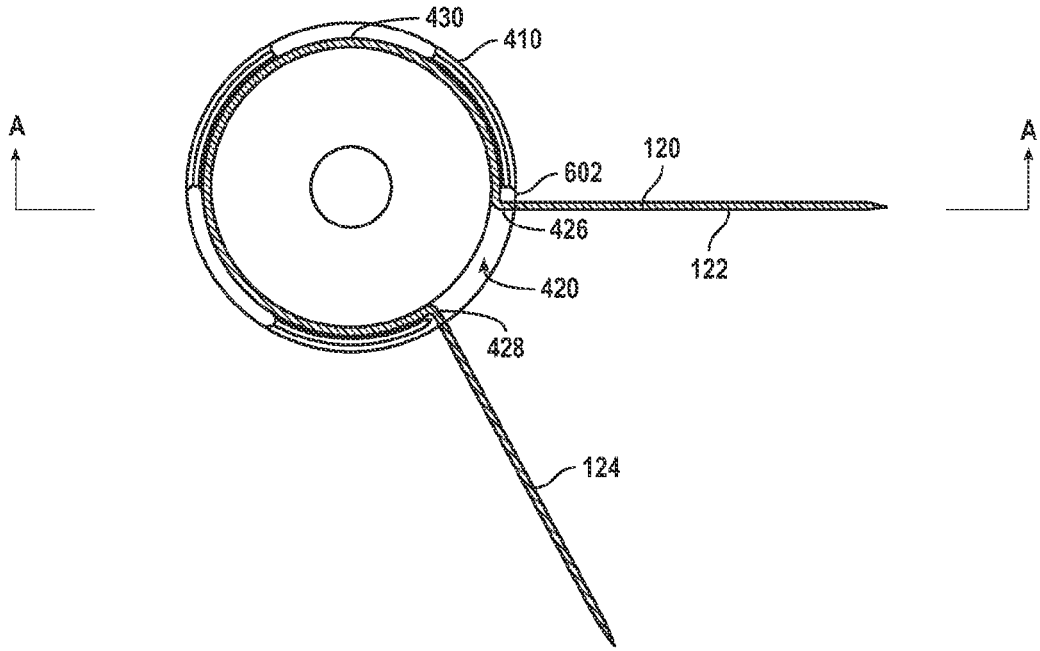
FIG. 6A is a top view of the body subassembly of FIG. 5 showing spur 120.

A loop (e.g., full turn, less than a full turn, multiple turns) and/or elbow of resilient material (e.g., a spring) may store a torsion. A loop may couple spikes to each other mechanically and/or electrically. A torsion applies pressure against a surface to deploy a spike electrode. For example, loop 430 of FIGS. 4, 5, and 6A is positioned in channel 420 of body subassembly 410 which is a portion of body 102. Channel 420 and corner 602 (typical of all symmetrically arranged corners of channel 420) provide surfaces for torsion to operate to move one or more spikes. Torsion in loop 430 and/or elbows 426 and 428 urges spikes 122 and 124 from a stowed position proximate to body subassembly 410 to a deployed position away from body subassembly 410. The circular form of loop 430 and the fact that loop 430 may be less than a full turn both contribute to reducing the space occupied by a spur. The spikes of a spur stow along the length of the body thereby also requiring little space.

Figure 6B:
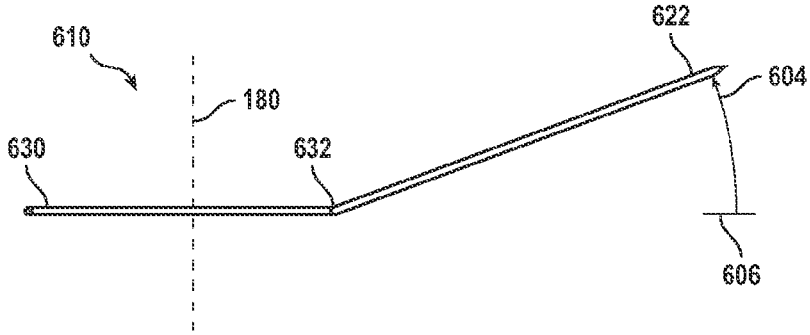
FIG. 6B is a cross-section of another spur according to various aspects of the present invention, that may be used in place of spur 120.
Figure 7:
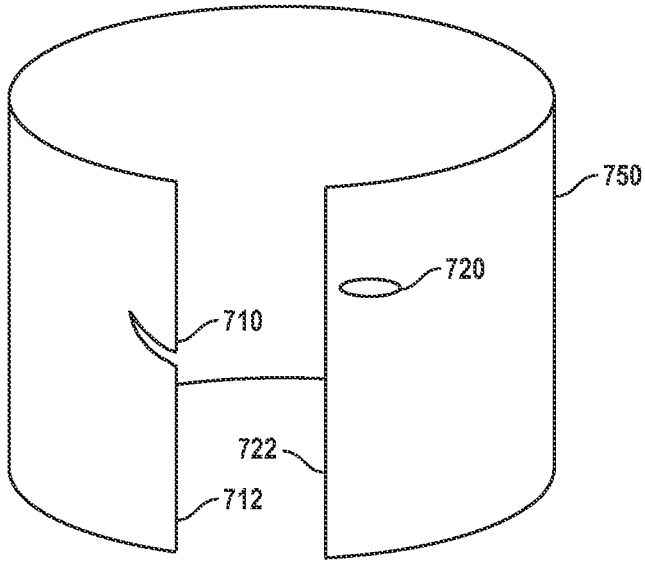
FIG. 7 is a perspective plan view of a film that may be used in place of the film of FIGS. 1 and 2.
Figure 8:
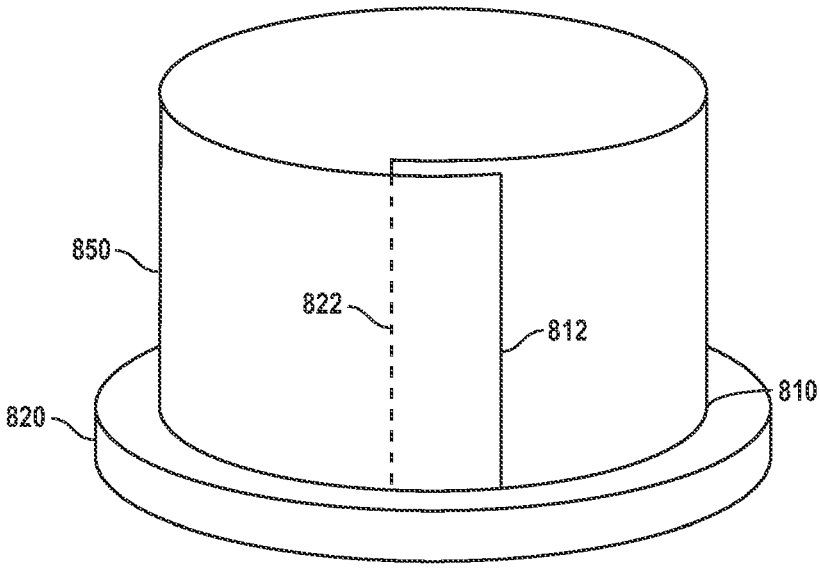
FIG. 8 is a perspective plan view of another film that may be used in place of the film of FIGS. 1 and 2.
Figure 9:
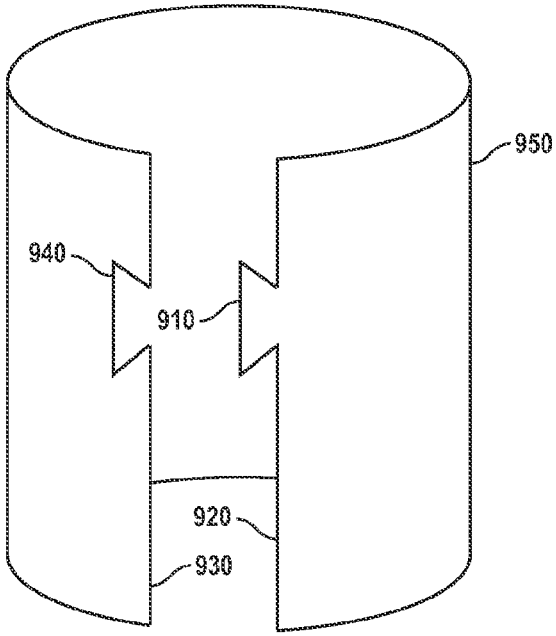
FIG. 9 is a perspective plan view of still another film that may be used in place of the film of FIGS. 1 and 2.
Figure 10:
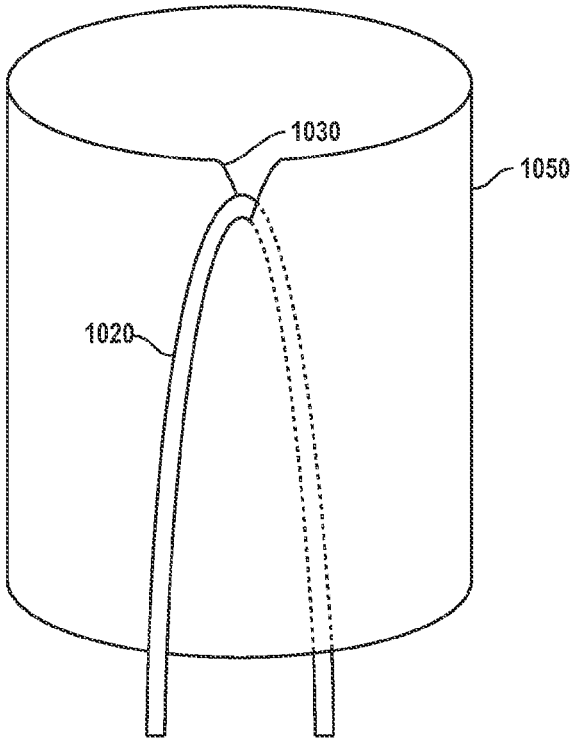
FIG. 10 is perspective plan view of yet another film that may be used in place of the film of FIGS. 1 and 2.

A loop portion and spikes may be formed in a plane for simplicity of manufacture. For example, spur 120 of FIGS. 3 and 5 deploys spikes to an angle of about 90 degrees from axis 180 of body 102 and further biases the spikes to return to that angle. In another implementation, spur 610 of FIG. 6B includes loop 630 and two spikes, of which spike 622 is typical. FIG. 6B shows a cross section of loop 630 that is from the same point of view as the cross section identified A-A for spur 120 in FIG. 6A. Loop 630 is analogous to loop 430 of spur 120. Spike 622 radiates from loop 630 through two bends. The first, elbow 632, is analogous to elbow 426 of spur 120. The second bend positions spike 622 out of the plane 606 that is perpendicular to axis 180 of body 102. Plane 606 may include a centerline of loop 630. The angle 604 from plane 606 to a centerline of spike 622 may be measured toward nose 130. Angle 604 may be acute (e.g., less than 90 degrees), from 0 to 45 degrees, preferably about 15 to 30 degrees, more preferably about 25 degrees. Spikes of a spur may be at the same or different respective angles 604. Deploying spurs at a variety of respective angles 604 may improve the likelihood of sufficient contact with target tissue.

Spikes may be formed of any material that conducts a stimulus signal. A loop may be formed of any material that stores a torsion. A spur may be formed of a single strand of wire, for example, 0.010 diameter stainless steel (e.g., type 301) of full hard temper and stress relieved after being formed as discussed herein. A spike may be straight from elbow to tip. A spike may include a bend toward the nose. One or more elbows may store torsion sufficient to perform the biasing functions of a spur. The spur's loop and spike structures may be formed of relatively nonresilient (e.g., stiff) material. An elbow may include a living hinge. Non-conductive materials for a loop, an elbow, and/or a spike may be coated with conductive material to serve as conductors.

A fastener, according to various aspects of the present invention, includes any structure for retaining a film in a fastened state. For example, thread 210 and perforations discussed above retain film 110 in a fastened state as described above. A fastener may be formed integral to a film. For example, a fastener may include a tab and an opening (e.g., an orifice, slot, or perforation). The tab cooperates with the opening to hold the film in the fastened position. Disrupting the cooperation of the tab with the opening permits release of the fastener and film. For example, tab 710 is formed in edge 712 and opening 720 in edge 722 of film 750. In the fastened position, tab 710 engages opening 720 thereby holding film 750 in a fastened position. Moving edge 712 relative to edge 722 pulls tab 710 from opening 720 thereby unfastening film 750. Tab 710 and opening 720 may cooperate as a hook and eye. Edge 712 may be coupled to nose 130 and edge 722 may be coupled to body 102 to unfasten film 750 on impact.

In another implementation, a fastener comprises a channel. Placement of the film in the channel retains the film in the fastened position. Removal of the film from the channel unfastens the film. For example, substantially rectangular film 850 forms a substantially cylindrical shape where edge 812 overlaps edge 822. One end of the cylinder is placed in channel 810 of fastener 820. Film 850 expands under a torsion to contact channel 810. Contact with channel 810 halts additional expansion thereby holding film 850 in a fastened position. Withdrawing film 850 from channel 810 unfastens film 850. Fastener 820 may be coupled to nose 130 and a portion of film 850 opposite fastener 850 may be coupled to body 102 to unfasten film 850 on impact.

In another implementation, a fastener integral to a film, comprises a dovetail and a notch. The dovetail cooperates with the notch to hold the film in the fastened position. Disrupting the cooperation of the dovetail with the notch permits release of the fastener and film. For example, tab dovetail 910 is formed in edge 930 and notch 940 is formed in edge 920 of film 950. In the fastened position, dovetail 910 engages notch 940 thereby holding film 950 in a fastened position. Moving edge 930 relative to edge 920 pulls dovetail 910 from notch 940 thereby unfastening film 950. Edge 930 may be coupled to nose 130 and edge 920 may be coupled to body 102 to unfasten film 950 on impact.

The force required to unfasten dovetail 910 from notch 940 may be increased by applying an adhesive to the joint. For example, tape may be positioned over dovetail 910 and notch 940. The support provided by the tape increases the force required to unfasten dovetail 910 from notch 940. Removal of the tape may also act to unfasten dovetail 910.

In another implementation, a film and fastener comprises a band and a wire. The film in the unfastened position mayform the band. The wire cuts the band to unfasten the film. For example, film 1050 is a band in a fastened position. A substantially rectangular film may form a band by coupling two edges of the film. Fastener 1020 is a wire coupled to the nose, the body or both the nose and the body. Film 1050 may be attached to the body or the nose. Wire 1020 cuts through film 110 as film 1050 separates from wire 1020. Cutting unfastens film 1050.

A round may include an apparatus for launching an electrified projectile. A round may omit a propellant when for example the round is for use with a launching apparatus that includes a supply of propellant (e.g., a launcher having a compressed air supply). Any conventional method of propelling a projectile may be used. An electrified projectile may include a propulsion system and/or propellant. A launching apparatus and/or a round may facilitate the simultaneous launching of any number of electrified projectiles. A round may include a case and a base having a form factor and made of materials suitable for use in a conventional weapon for breach loading or muzzle loading (e.g., cannon, mortar, 40 mm grenade launcher, flare gun, musket, 12-guage shotgun, 20-guage shotgun, pistol). The weapon may initiate launch of the projectile by any conventional apparatus (e.g., percussion firing pin, switched electrical current).

Figure 11:
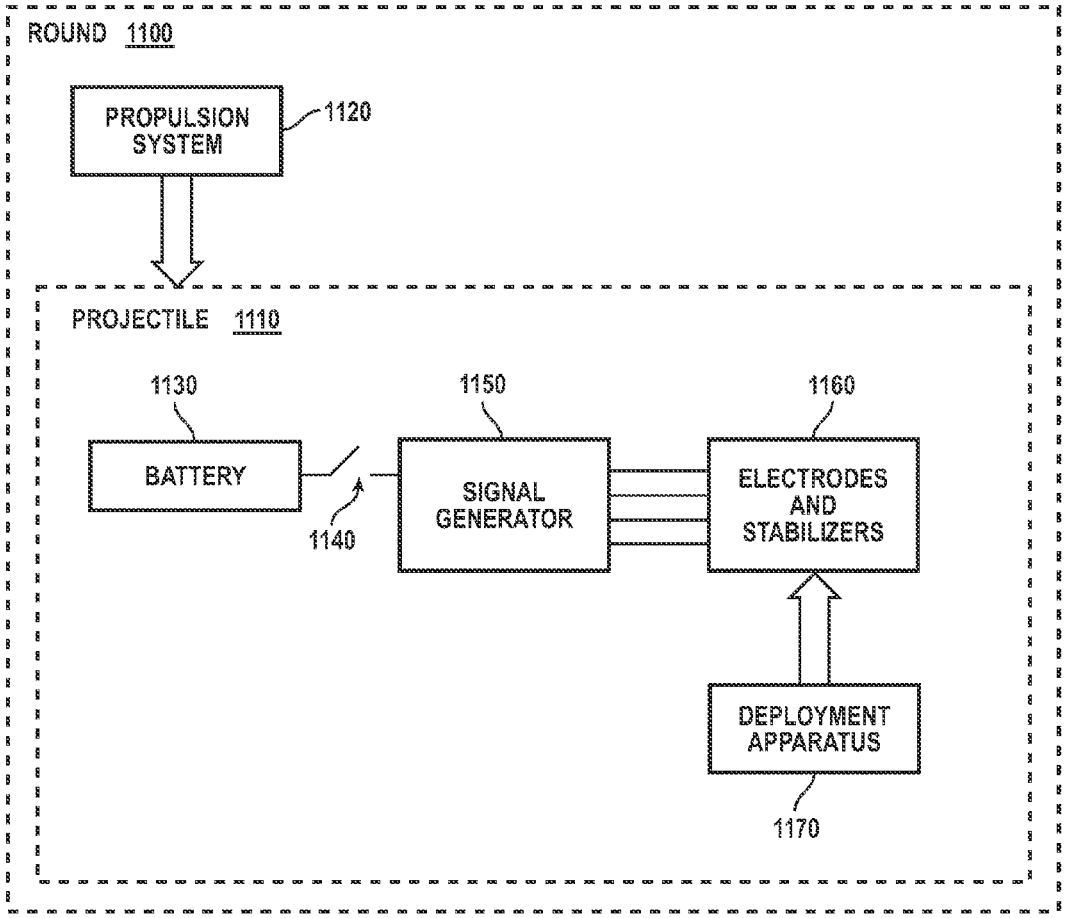
FIG. 11 is a functional block diagram of a round, according to various aspects of the present invention.

For example, round 1100 of FIG. 11 includes propulsion system 1120 and projectile 1110. In operation, round 1100 is placed in a weapon. The weapon provides a launch signal or action received by propulsion system 1120. Responsive to the launch signal or action, propulsion system 1120 launches projectile 1120 out of the weapon and toward a target.

An electrified projectile includes any apparatus that travels toward a target, places electrodes on a target, and delivers a stimulus signal from a circuit of the projectile through the electrodes and through the target. An electrified projectile may deliver a stimulus signal by transporting to the target a source of energy and a signal generator. For example, projectile 1110 includes battery 1130, switch 1140, signal generator 1150, electrodes and stabilizers 1160, and deployment apparatus 1170. Deployment apparatus 1170 deploys an electrodes and stabilizers. Examples of deployment of electrodes and stabilizers are discussed above. Battery 1130 provides energy to signal generator 1150 to provide a stimulus signal through the deployed electrodes and through the target. Switch 1140 couples battery 1130 to signal generator 1150.

Switch 1140 may be closed to provide energy to signal generator 1150 at any time. For example, switch 1140 may be closed for a short period during assembly of round 1100 for testing. Switch 1140 may be closed upon insertion of round 1100 into a weapon. To conserve battery power, switch 1140 may be closed upon impact of projectile 1110 with a target. Preferably, switch 1140 is closed upon launch of projectile 1110 so that signal generator 1150 prepares a stimulus signal during flight. Conserving battery power may increase a duration of providing a stimulus signal through the target.

Any conventional method of propelling a projectile may be used. A launching apparatus and/or a round may facilitate the simultaneous launching of any number of electrified projectiles. A round may include a case and a base having a form factor and made of materials suitable for use in a conventional weapon for breach loading or muzzle loading (e.g., cannon, mortar, 40 mm grenade launcher, flare gun, musket, 12-gauge shotgun, 20-gauge shotgun, pistol). The weapon may initiate launch of the projectile by any conventional apparatus (e.g., percussion firing pin, switched electrical current).

Figure 12:
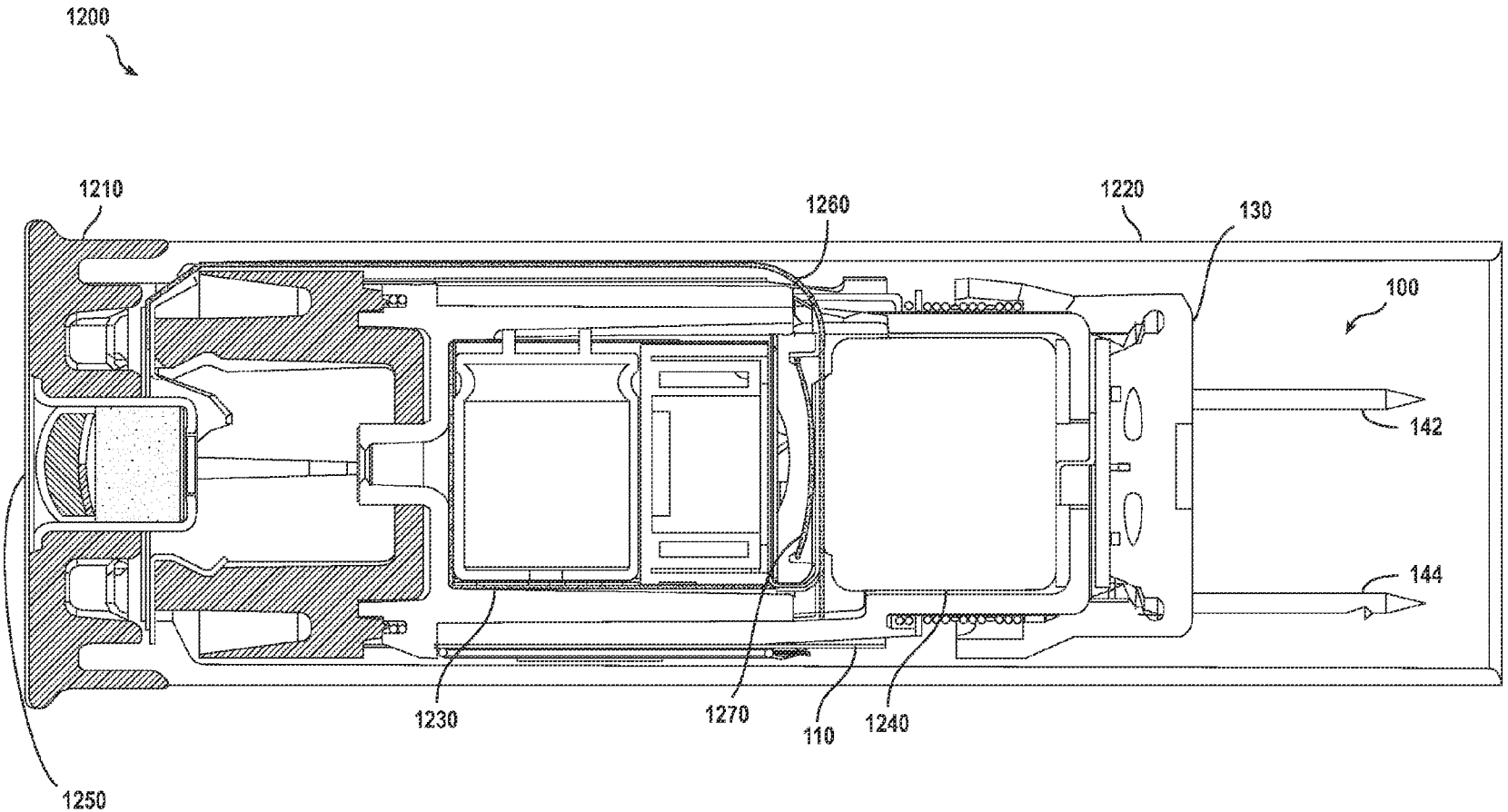
FIG. 12 is cross-section of a round of FIG. 11 with a projectile of FIGS. 1 through 6.

For example, round 1200 of FIG. 12 includes case 1220, base 1210, and projectile 100. Base 1210 may include a propellant to launch projectile 100 toward a target. For example, base 1210 includes propellant 1250. Electrified projectile 100 includes signal generator 1230, battery 1240, and switch 1260. Prior to launch, switch 1260 separates leaf spring 1270 (a conductor to signal generator 1230) from battery 1240. An end portion of switch 1260 is anchored to base 1210. At launch, electrified projectile 100 exits case 1220. Switch 1260 withdraws from between leaf spring 1270 and battery 1240 such that battery 1240 contacts leaf spring 1270 thereby establishing an electrical connection with signal generator 1230. Switch 1260 remains in case 1220 after launch.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. An projectile for delivering a current through a target, the projectile comprising:

a body;

a signal generator within the body to provide the current; and an electrode formed of wire, the electrode comprises a loop, the loop is mechanically coupled to the body, the electrode for delivering the current; wherein the loop encircles a portion of a circumference of the body during and after deployment;

the electrode has a stowed position and a deployed position;

a torsion is stored in the wire; and the torsion moves the electrode from the stowed position to the deployed position.

2. The projectile of claim 1 wherein the electrode further comprises a spike for delivering the current.

3. The projectile of claim 2 wherein the torsion moves the spike to move the electrode from the stowed position to the deployed position.

4. The projectile of claim 1 wherein the torsion is stored in the loop.

5. The projectile of claim 1 wherein:

a substantial portion of the loop is formed in a plane; and the plane is substantially perpendicular to an axis of spin of the projectile while in flight.

6. The projectile of claim 1 wherein the loop has an arcuate shape that remains substantially the same during and after deployment.

7. The projectile of claim 1 wherein a length of the loop is constant.

8. The projectile of claim 1 wherein a length of the loop is less than a circumference of the body.

9. The projectile of claim 1 wherein:

the projectile further comprises a film; and the film retains a portion of the electrode proximate to the body in the stowed position.

10. The projectile of claim 1 wherein:

the projectile further comprises a film;

the film has a fastened position and an unfastened position; and the torsion moves the film away from the fastened positioned.

11. The projectile of claim 1 wherein:

the electrode further comprises a first spike; and the current is delivered by the first spike.

12. The projectile of claim 11 wherein the torsion moves the first spike to move the electrode from the stowed position to the deployed position.

13. The projectile of claim 11 wherein the torsion is stored in the loop.

14. The projectile of claim 11 wherein:

the body comprises a channel; and the loop is disposed in the channel to mechanically couple the electrode to the body.

15. The projectile of claim 14 wherein the channel is disposed around an axis of the body.

16. The projectile of claim 14 wherein after deployment, the loop remains disposed in the channel.

17. The projectile of claim 11 wherein the loop has an arcuate shape that remains substantially the same during and after deployment.

18. The projectile of claim 11 wherein a length of the loop is constant.

19. The projectile of claim 11 wherein a length of the loop is less than a circumference of the body.

20. The projectile of claim 11 wherein:

the electrode further comprises a living hinge between the loop and the first spike; and the torsion rotates the first spike around the living hinge to move the electrode from the stowed position to the deployed position.

21. The projectile of claim 11 wherein:

the electrode further comprises a second spike; and the torsion rotates the first spike and the second spike to move the electrode from the stowed position to the deployed position.

22. The projectile of claim 11 wherein:

the projectile further comprises a film; and the film retains the first spike proximate to the body in the stowed position.

23. The projectile of claim 11 wherein before deployment, a tip of the first spike is oriented toward a rear of the body.

24. The projectile of claim 11 wherein before deployment, a tip of the first spike is oriented substantially parallel to an axis of spin of the projectile while in flight.

25. The projectile of claim 11 wherein after deployment, a tip of the first spike is oriented substantially perpendicular to an axis of spin of the projectile while in flight.

26. The projectile of claim 1 wherein:

the electrode further comprises a first spike and a second spike;

the first spike is mechanically coupled to the loop; and the second spike is mechanically coupled to loop.

27. The projectile of claim 26 wherein the torsion is stored in the loop.

28. The projectile of claim 26 wherein at least one of the first spike and the second spike for delivering the current.

* * * * *